US005482399A

United States Patent [19]

Bright et al.

[11] Patent Number: 5,482,399

[45] Date of Patent: Jan. 9, 1996

[54] FORMATION OF CELLULAR RIGID PAVEMENT

[76] Inventors: John K. Bright, 12910 W. 24th Pl., Golden, Colo. 80401; Donald C. Taylor, 13450 W. Ohio Ave., Lakewood, Colo. 80228

[21] Appl. No.: 163,002

[22] Filed: Dec. 8, 1993

[51] Int. Cl.[6] ..... E01C 7/00

[52] U.S. Cl. ..... 404/17; 404/28; 52/169.5

[58] Field of Search ..... 404/18, 27, 28, 404/31, 32, 34, 35, 36, 44, 70; 52/169.11, 169.5, 454, 577, 687, 801, 811, 169.7

[56] References Cited

U.S. PATENT DOCUMENTS 3,352,079 11/1967 Strong ..... 52/577

4,702,048 10/1987 Millman ..... 52/169.5

*Primary Examiner*—Ramon S. Britts
*Assistant Examiner*—Pamela A. O'Connor
*Attorney, Agent, or Firm*—Charles J. Brown

[57] ABSTRACT

A method of forming cellular rigid pavement utilizing a planar orthogonal matrix of upwardly convex domed forms over which concrete is poured to create a corresponding matrix of voids within the concrete around which downward loads are distributed and which minimizes pavement warpage and concrete volume, and a panel of such domed forms used in practicing the method.

18 Claims, 2 Drawing Sheets

FORMATION OF CELLULAR RIGID PAVEMENT

BACKGROUND OF THE INVENTION

Pavement for roads, parking lots, airport runways, and so forth is generally of two types, rigid or flexible. Rigid pavement is formed principally of cement, whether natural or manufactured such as portland cement, crushed stone, sand and water for hydration. Flexible pavement on the other hand is formed principally of asphaltic or bituminous materials with aggregate. Flexible pavement is notably less expensive than rigid pavement but its useful life is much shorter and its load bearing ability is measurably less.

It is a principal purpose of the present invention to improve upon rigid pavement so as to achieve substantial reduction in material volume and yet preserve its superior load bearing ability. The object is to make strong durable rigid pavement cost competitive with less expensive flexible pavement.

The crux of the invention achieving these goals is the creation of voids within rigid pavement. The concept is not applicable to flexible pavement because asphaltic and bituminous materials are inherently too weak to permit such voids. Also, flexible pavement materials tend to creep during use over time and this would result in deformation and even crushing of any voids within the pavement structure.

Major runways, taxiways and aprons are seldom made of flexible pavement because their useful life is too short and they are unable to withstand the high loading imposed from heavy commercial or military aircraft use at reasonable cost. The main objectives of the present invention described above, namely reduction of pavement material volume while maintaining high load resistance, are particularly applicable to airport runways, taxiways and aprons.

Formation of voids within roadway surfacing material is not in itself novel. U.S. Pat. Nos. 4,801,217, 4,815,963 and 4,850,738 are examples disclosing roadway materials formed with voids, for example an underlayment for roads built over swampy or unstable ground. However, none of those references concerns rigid concrete pavement. Forms of various types which are used to create cellular slabs permitting water drainage are also well known, such as those described in U.S. Pat. Nos. 4,574,541 and 5,030,343. Again, however, prior art drainage panels and cells such as these do not concern rigid pavement.

SUMMARY OF THE INVENTION

The invention provides a method of forming a cellular rigid pavement slab over an area to be paved. First a substantially planar base surface is prepared throughout the area. A multiplicity of upwardly convex dome forms are then disposed over the base surface in an extended substantially planar orthogonal matrix with portions of the base surface exposed adjacent each of the dome forms. The matrix of dome forms and the exposed base surface are then covered with flowable settable rigid pavement material. That pavement material is then set to form a unitary slab of rigid pavement. By this method the dome forms create an extended orthogonal matrix of voids within the slab around which downward loads are distributed and which minimizes slab warpage and pavement material volume.

In a preferred form of the method of the invention, the dome forms are shells capable of supporting the flowable pavement material before setting. The dome form shells may be substantially hemispherical creating similarly shaped voids around which downward loads on the pavement slab are distributed triaxially.

The matrix of dome forms may be in panels laid over the base surface. Each panel may comprise substantially uniformly spaced upwardly convex substantially hemispherical dome forms interconnected by a substantially uniform lattice of weeps radiating from the respective lower peripheries of the dome forms. The weeps may form drainage passages in the set rigid pavement slab.

The panels are preferably rectangular and a rectilinear scrim border may define the panel edges intersecting only weeps and none of the dome forms. The weeps may be inverted channels providing interconnected drainage passages on their undersides. The panels may be laid over the base surface edge-to-edge with drainage passages formed by each panel communicating with the drainage passages formed by adjoining panels.

The base surface may be defined by a graded base course laid over a substantially planar subgrade. The pavement material may be portland cement concrete.

The invention also provides a panel for use in forming a cellular rigid pavement slab over an area to be paved. The panel comprises a multiplicity of substantially uniformly spaced upwardly convex dome form shells arranged in an extended orthogonal matrix. A lattice of components interconnects the respective dome form shells and defines openings around the shells. The components of the lattice are preferably weeps with channelled undersides. The components may radiate from and interconnect the respective lower peripheries of the dome form shells. The panel may include a border element defining the panel edges and interconnecting only certain of the aforementioned components and none of the dome forms. In a preferred form the panel is rectangular, the shells are hemispherical and the components are semi-cylindrical in cross section.

BRIEF DESCRIPTION OF THE DRAWINGS

FIG. 4 is an enlarged fragmentary section laterally through the scrim border of the panel, taken along the

DESCRIPTION OF PREFERRED EMBODIMENT

Figure 1:
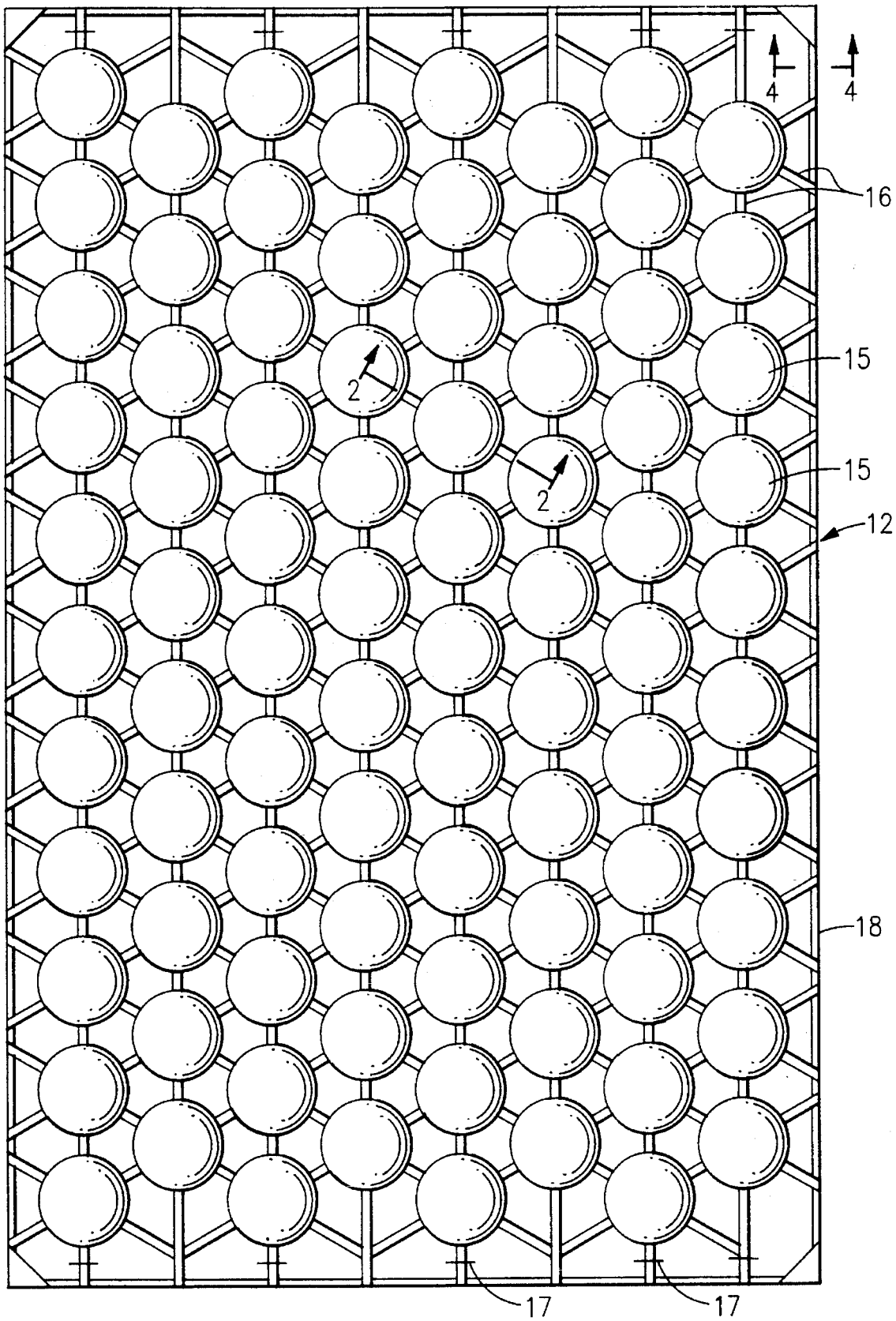
FIG. 1 is a plan view of one panel of the invention.
Figure 2:
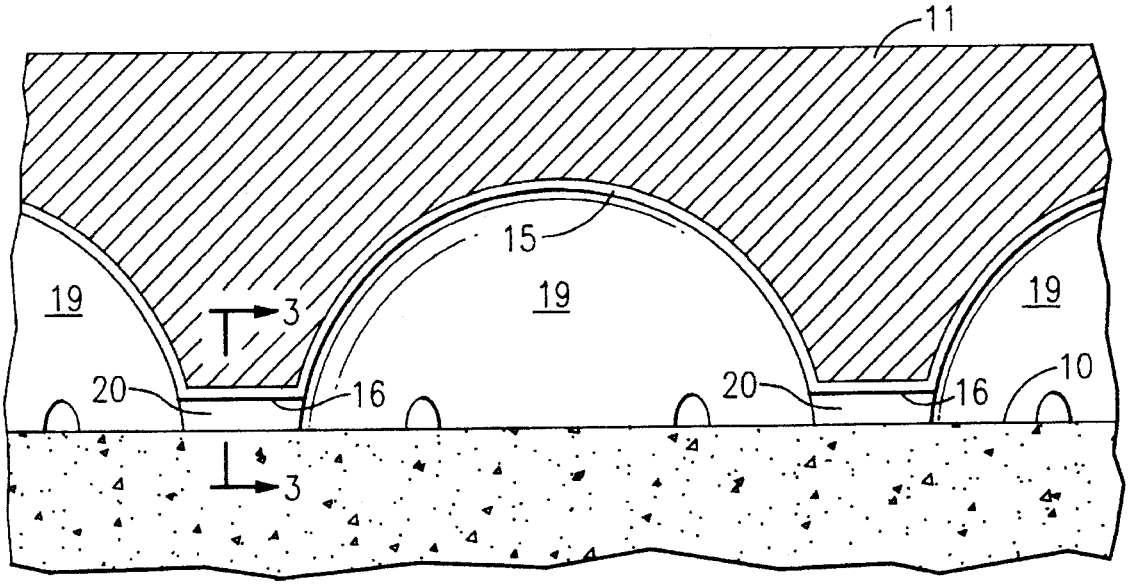
FIG. 2 is an enlarged fragmentary section through one of the hemispherical dome form shells and portions of those adjoining it, taken along the line 2—2 of FIG. 1, and showing the underlying base course and the covering slab of rigid pavement when the panel is put to use.

Referring first to FIGS. 1 and 2 the practice of the method of the invention begins with preparation of the area to be paved by creating a substantially planar base surface 10. The particular manner in which this base surface is created is no part of the invention. It may involve the initial preparation of the subgrade, perhaps by scarifying and compacting the natural grade and then stabilizing it with lime. Upon this subgrade a base course is typically formed, perhaps more than one, comprising compacted gravel or crushed stone often with stabilizers added, which may then be graded and rolled. Whatever the initial preparation of the planar base surface 10, the ultimate step is to cover that surface with a settable rigid pavement slab 11. Typically this pavement material is portland cement concrete trucked to the site in a water-cement mix of a ratio which maintains maximum stiffness but not so much that the mixture cannot slide down a chute during placement. The placed concrete is typically conveyed laterally and longitudinally and perhaps vibrated, and then broomed to form the final desired surface. The pavement may or may not be reinforced with steel bars. Commonly used jointing, joint support and joint sealing may be utilized. Several weeks typically are required for complete setting of the placed concrete before it is ready for full traffic use.

In FIG. 1 a single panel 12 is illustrated for use in the practice of the method of the invention. The panel 12 is of unitary construction composed, for example, of recycled particulate plastic compressed under elevated temperature conditions into board-like self-supporting form. Variations of paper-based self-supporting compositions such as plasticized waste or paper maché may also be utilized provided they have sufficient strength to withstand the steps of the claimed method described hereinafter.

Each panel 12 is rectangular and comprises a multiplicity of substantially uniformly spaced upwardly convex substantially hemispherical dome form shells 15. In this embodiment the shells 15 are arranged in parallel longitudinal rows which are staggered laterally so that each shell 15, not along an edge of the panel, is surrounded by six equally spaced shells. Alternatively the shells could be arranged one next to the other in straight longitudinal and lateral rows, in which case each shell, not along an edge of the panel, would be surrounded by four equally spaced adjacent shells.

Figure 3:
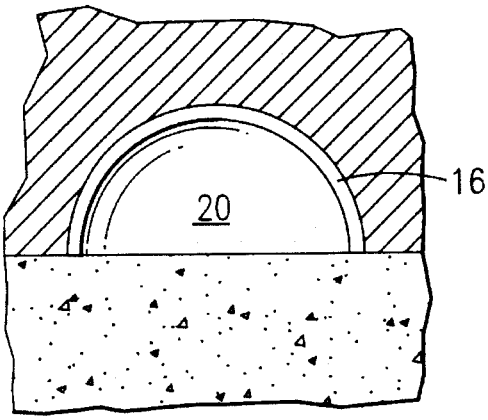
FIG. 3 is an enlarged lateral section through one of the weeps taken along the line 3—3 of FIG. 2.

All of the shells 15 are interconnected by a substantially uniform lattice of weeps 16 having a semi-cylindrical inverted cross section as shown in FIG. 3. Thus the weeps 16 define channelled undersides which form drainage passages. The weeps 15 radiate from the respective lower peripheries of the dome form shells 15 to form an extended substantially planar matrix with portions of the base course exposed around the shells 15 and weeps 16.

Figure 4:
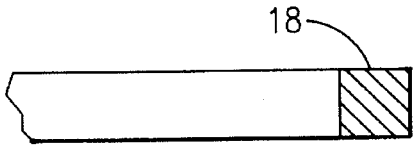

To lend strength and some degree of rigidity to the panel 12 a rectilinear scrim border 18 defines the four panel edges. The cross section of the border 18 is illustrated in FIG. 4. It is preferable that the border 18 intersect only the weeps 16 and none of the dome form shells 15.

A preferred size for the rectangular panel 12 is twelve feet long and eight feet wide. It is conventional that a single lane of road pavement is twelve feet in width and thus the length of one panel can span one lane. Eight feet is an acceptable lateral dimension for panels carried on a flatbed truck without wide-load warning measures, and hence the panels 12 can be stacked for transport longitudinally along the length of a truck flatbed.

In the practice of the method a substantially planar subgrade is formed over the area to be paved and then a grade base course is disposed over the subgrade having the exposed surface 10 described hereinbefore. A plurality of panels 12 are then laid cross-wise along the intended course of the road lane to be paved. In a straight course the panels 12 are laid side-edge to side-edge, whereas in a curved course they may be laid with corners touching on the inside of curve and spaced on the outside of curve. Fastening devices such as staples 17 shown in FIG. 1 are applied over selected weeps 16 along the shorter side edges of each panel 12 to hold the panel firmly against the base surface 10. To maintain positive drainage care should be taken to insure that all of the weeps 16 intersected by the border 18 along the edges of the panel are aligned with corresponding weeps 16 in the adjacent panel. Opposed weeps on panels separated slightly on a curved source may be connected by appropriate taping as well.

This matrix of dome form shells 15 and weeps 16 and the exposed base surface 10 around the shells 15 and weeps 16 are then covered with a layer of the previously described flowable settable concrete to form the slab 11 which is then allowed to set in the conventional manner. It will be apparent that when the concrete of the slab 11 is set it forms a rigid pavement slab which is cellular in the sense that hemispherical voids 19 are formed beneath its surface by the shells 15. Traffic load imposed downwardly on the upper surface of the concrete slab 11 is distributed triaxially around each dome shaped void with close to the same load-bearing capacity as a solid concrete slab. Yet substantially less concrete is required for the cellular slab 11 of the invention because of the voids. For example a pavement slab of eight inch thickness may have dome form shells 15 of six and one half inches in radius. With those dimensions a reduction in pavement material volume of more than thirty percent is achieved. The shell thickness in that example would be approximately one-sixteenth of an inch.

In addition to the hemispherical voids 19 the set concrete slab 11 also includes drainage passages 20 formed by the weeps 16 as shown in FIG. 3. These passages 20 interconnect through the hemispherical voids 19 and from one panel 12 to the next across the border 18 to allow any water percolating upwardly from the subgrade or seeping downwardly from road surface to drain away easily.

In addition to minimizing the volume of concrete necessary for a given slab 11 without measurably impairing load-bearing ability, a further advantage of a rigid pavement slab formed in accordance with the invention is that it is substantially less susceptible to warpage as compared to a solid concrete slab. Warpage is a result of temperature differentials from the exposed upper surface of the concrete slab 11 to its underside lying against the base surface 10. Under the warmth of the sun during the day the upper surface of a concrete slab tends to be warmer then its undersurface. Thermal expansion in the warmer upper layers of the slab cause the slab to bulge slightly upwardly in a convex fashion. Under night time conditions the upper surface of the slab tends to be cooler than the underside and reverse warpage occurs, namely thermal contraction of the upper regions of the slab causing concave bending with the edges of the slab tending to lift off the base surface. The night time condition of convex warpage is more serious in that cracking of the uplifted slab edge portions is more likely to occur under load than crushing of the central convex bulge caused by daytime conditions.

The thicker a given slab, the greater will be its tendency to warp as a result of differential temperature. With the cellular pavement of the invention the average thickness of the concrete slab 11 is substantially less than its total thickness from the base surface 10 up to the exposed upper surface of the slab. The cellular slab 11 of the invention therefore undergoes measurably less thermal warpage than a solid slab of the same total thickness.

The scope of the invention is to be determined by the following claims rather than the foregoing description of a preferred embodiment.

We claim:

1. A method of forming a cellular rigid pavement slab over an area to be paved which comprises a) preparing a substantially planar base surface throughout said area, b) disposing a multiplicity of upwardly convex dome forms over the base surface in an extended substantially planar orthogonal matrix with portions of the base surface exposed adjacent each of the dome forms, c) interconnecting the dome forms with a lattice of weeps having channelled undersides, d) covering the matrix of dome forms and the lattice of weeds and the exposed base surface with flowable settable rigid pavement material, and e) setting the pavement material to form a unitary slab of rigid pavement, f) whereby the dome forms create an extended orthogonal matrix of voids within the slab around which downward loads are distributed and which minimize slab warpage and pavement material volume and the weeps create drainage passages interconnecting said voids to allow water percolating upwardly through the base surface or downwardly through the slab to drain away.

2. A method according to claim 1 wherein the dome forms are shells capable of supporting the flowable pavement material before setting thereof.

3. A method according to claim 2 wherein the dome form shells are substantially hemispherical creating voids around which downward loads on the pavement slab are distributed triaxially.

4. A method according to claim 1 wherein the matrix of dome forms are in panels laid over the base surface, each panel comprising substantially uniformly spaced upwardly convex substantially hemispherical dome forms interconnected by a substantially uniform lattice of weeps radiating from the respective lower peripheries of the dome forms, the weeps forming drainage passages in the set rigid pavement slab.

5. A method according to claim 4 wherein the panels are rectangular and a rectilinear scrim border defines the panel edges intersecting only weeps and none of the dome forms.

6. A method according to claim 4 wherein the weeps are inverted channels providing interconnected drainage passages on their undersides.

7. A method according to claim 5 wherein the panels are laid over the base surface edge-to-edge with drainage passages formed by each panel communicating with the drainage passages formed by adjoining panels.

8. A method according to claim 1 wherein the base surface is defined by a graded base course laid over a substantially planar subgrade.

9. A method according to claim 1 wherein the pavement material is portland cement concrete.

10. A method of forming a cellular rigid pavement slab over an area to be paved which comprises a) preparing a substantially planar subgrade over the area to be paved, b) laying a graded base course over the subgrade, c) disposing over the base course a plurality of panels which comprise a multiplicity of substantially uniformly spaced upwardly convex substantially hemispherical dome form shells interconnected by a substantially uniform lattice of weeps with channelled undersides radiating from the respective lower peripheries of the dome form shells to form an extended substantially planar orthogonal matrix with portions of the base course exposed around the dome form shells and weeps, d) covering the matrix of dome form shells and weeps and the exposed barbs surface with a layer of flowable settable portland cement concrete, and e) setting said concrete to form a slab of rigid pavement, f) whereby the dome form shells create an extended orthogonal matrix of substantially hemispherical voids around which downward loads on the pavement are distributed triaxially and the weeps create interconnecting drainage passages and slab warpage and concrete volume are minimized and the weeps create drainage passages interconnecting said voids to allow water percolating upwardly through the base surface or downwardly through the slab to drain away.

11. A method according to claim 10 wherein the panels are rectangular and a rectilinear scrim border defines the panel edges intersecting only weeps and none of the dome forms.

12. A method according to claim 11 wherein the panels are laid over the base surface edge-to-edge with drainage passages formed by each panel communicating with the drainage passages formed by adjoining panels.

13. For use in forming a cellular rigid pavement slab over an area to be paved, a panel comprising a) a multiplicity of substantially uniformly spaced upwardly convex dome form shells arranged in an extended orthogonal matrix, and b) a lattice of weeps with channelled undersides interconnecting the respective dome form shells and defining openings around the shells, c) whereby when the panel is covered by the slab the shells create voids and the weeps create drainage passages interconnecting said voids to allow water percolating upwardly or downwardly to drain away.

14. A panel according to claim 13 wherein the components of the lattice are weeps with channelled undersides.

15. A panel according to claim 13 wherein the components of the lattice radiate from and interconnect the respective lower peripheries of the dome form shells.

16. A panel according to claim 13 which includes a border element defining the panel edges and interconnecting only certain of said components and none of the dome forms.

17. A panel according to claim 13 wherein the panel is rectangular, the shells are hemispherical and the components are semi-cylindrical in cross section.

18. For use in forming a cellular rigid pavement slab over an area to be paved a panel comprising a) a multiplicity of substantially uniformly spaced upwardly convex hemispherical shells arranged in an extended orthogonal matrix, b) a lattice of weeps of inverted semi-cylindrical cross section with channelled undersides radiating from and interconnecting the respective lower peripheries of the dome form shells and defining openings around the shells, and c) a rectangular border element defining the panel edges and interconnecting only certain of said weeps and none of the dome forms, d) whereby when the panel is covered by the slab the shells create voids and the weeps create drainage passages interconnecting said voids to allow water percolating upwardly or downwardly to drain away.

* * * * *